United States Patent [19]

Holenstein et al.

[11] 4,373,247

[45] Feb. 15, 1983

[54] METHOD AND DEVICE FOR REMOVING A RING TRAVELLER FROM THE RING OF A RING-SPINNING OR RING-TWISTING FRAME

[75] Inventors: Ernst Holenstein; Paul Ramseier, both of Pfäffikon, Switzerland

[73] Assignee: Bräcker AG, Pfäffikon, Switzerland

[21] Appl. No.: 182,465

[22] Filed: Aug. 28, 1980

[30] Foreign Application Priority Data

Sep. 14, 1979 [CH] Switzerland ..... 8330/79

[51] Int. Cl.[3] ..... B23P 19/00

[52] U.S. Cl. ..... 29/426.6; 29/225; 29/765

[58] Field of Search ..... 29/225, 765, 426.5, 29/426.6

[56] References Cited

U.S. PATENT DOCUMENTS

| | | | |
|---|---|---|---|
| 439,994 | 11/1890 | Ballard | 29/225 |
| 1,636,448 | 7/1927 | Whipple | 29/765 |
| 3,100,334 | 8/1963 | Ramseier | 29/765 |
| 3,191,284 | 6/1965 | Eurey . | |
| 3,686,736 | 8/1972 | Sanchez et al. | 29/765 |

FOREIGN PATENT DOCUMENTS

| | | |
|---|---|---|
| 56466 | 7/1967 | Fed. Rep. of Germany . |
| 63534 | 7/1981 | Switzerland . |

*Primary Examiner*—Lowell A. Larson
*Attorney, Agent, or Firm*—Werner W. Kleeman

[57] ABSTRACT

A tool is supported by a support face on the upper side of a spinning or twisting ring, with a bearing face bearing on the outer edge of the ring. A hook engages by a tip below the inner end of a ring traveller, which is brought into a predetermined position by a permanent magnet let into a support part. By actuating the tool, the hook is moved in the direction of the support face, so that it lifts the ring traveller over the inner edge of the ring. After passing over the inner edge and due to its spring action, the expanded ring traveller jumps into a channel, which leads to a collecting container. With such a removal of the ring traveller from the ring, the yarn drawn by the ring traveller remains undamaged.

9 Claims, 5 Drawing Figures

METHOD AND DEVICE FOR REMOVING A RING TRAVELLER FROM THE RING OF A RING-SPINNING OR RING-TWISTING FRAME

BACKGROUND OF THE INVENTION

The invention relates to a method and device for removing a ring traveller from the ring of a ring-spinning or ring-twisting frame.

A tool of this type for a ring with a horizontal flange is known from Swiss Pat. No. 63 534. This known tool is constructed in the manner of pliers, in which case the first side of the pliers serves as a lateral abutment for the ring traveller located on the ring. The other side is connected to a wedge-shaped mandrel engaging below the ring traveller above the ring and directed towards the first side. As a rearwards extension of the mandrel, this tool comprises a rod-like bent collecting device, on which the ring travellers removed are threaded in a row. When the two handle parts are pressed together, the mandrel engages below the ring traveller and penetrates a recess located in the first side, so that both ends of the ring traveller are lifted over the flange of the ring.

In this known tool, when removing the ring traveller from the ring, there is a danger that the yarn extending through the ring traveller is damaged or even torn. This is presumably the reason why a tool of this type which has been known for a long time is not encountered in practice, although there is a need for such a tool.

In practice it is useful to remove the ring travellers from the ring by means of hooks, mandrels, cords, tubes etc.; or even by striking them with a hammer. With a removal of this type, the ring travellers or parts thereof snap off and land somewhere in the vicinity, for example on the floor or in the waste material, from which they can only be sorted with difficulty or not at all. Also, ring travellers which snap off present a risk of injury, in particular to the eyes.

SUMMARY OF THE INVENTION

It is therefore an object of the invention to provide a method and device which facilitates the removal of ring travellers, without the yarn extending through the ring traveller being damaged in so doing.

The method according to the invention and the tool intended for carrying out the method facilitate controlled engagement and tensioning of the ring traveller, so that the latter snaps off the ring in a predetermined direction. When it is snapped off, during the removal of the tension, in addition to the acceleration in the axial or radial direction, according to the construction of the ring flange, the ring traveller obtains an accelerating component at its raised end, due to the rounded edge of the ring flange. This additional/component sets the ring traveller in a rotary movement in its own plane, due to which it releases the yarn and leaves the latter undamaged. The controlled direction of departure of the ring traveller thus facilitates interception of the latter.

A preferred embodiment ensures that before being engaged by the hook-like part, the ring traveller is brought by simple means into a predetermined position, without a special operation being required for this, since it is sufficient to move the tool towards the ring traveller.

When placing the tool on the ring, a preferred embodiment provides a well defined position of the hook-like part with respect to the ring and at the same time a basis for positioning of the ring traveller.

One embodiment makes it difficult for ring travellers in the collecting container to slide out, by providing a retaining shoulder.

BRIEF SUMMARY OF THE DRAWINGS

One embodiment of the object of the invention will be described hereafter with reference to the drawings in which.

DETAILED DESCRIPTION OF THE PREFERRED EMBODIMENTS

Figure 1:
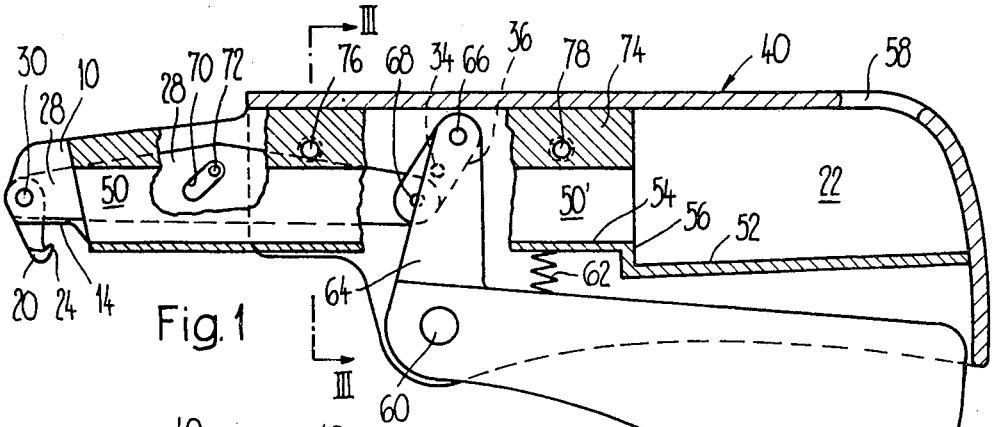
FIG. 1 shows a tool for removing a ring traveller in longitudinal section.

The tool illustrated in FIG. 1 comprises a first handle part 40 and a second handle part 38 defining handle means, which parts 38 and 40 are able to move with respect to each other about a pivot 60. A spring 62 serves for spreading the two handle parts 38, 40 apart. The cross section of the first handle part 40 surrounds the second handle part 38 as far as the pivot 60 and thus forms an inverted U. Thus, in practice, the first handle part 40 serves as a housing, in which the major part of the remaining components are located. The second handle part 38 is rigidly connected to a lever arm 64 extending from the pivot at right angles to the second handle part 38. The lever arm 64 engages by its end over a pin 66 at one end of a fish-plate 36 able to pivot about a pivot 34. The pivot 34 is secured in the first handle part 40. The other end of the fish-plate 36 is pivotally connected by a pin 68 to an intermediate member 28. In its central region, the intermediate member 28 comprises an oblique slot 70, through which it is guided on a pin 72 located in the first handle part 40,74 so that it moves upwards simultaneously when it is pulled upwards into the first handle part 40 by way of the lever arm 64 and the fish-plate 36 swinging in counter-clockwise direction, when the two handle parts 38 and 40 are pressed together. A hook or hook-like element 20 defining gripper means, which is able to pivot about a pivot 30, is located on the end of the intermediate member 28 remote from the fish-plate 36.

A support part or element 10 located close to the hook 20 is formed by a side wall of a channel 50, which side wall is extended forwards and which channel 50 opens into a collecting container 22 by its region 50' in the rear part of the tool. The bottom of the collecting container 22 is deeper than the bottom 54 of the channel 50,50' due to a shoulder 56. Located on the upper side of the collecting container 22, which is defined by the first handle part 40, is a non-closable opening 58 for emptying the collecting container 22.

Figure 2:
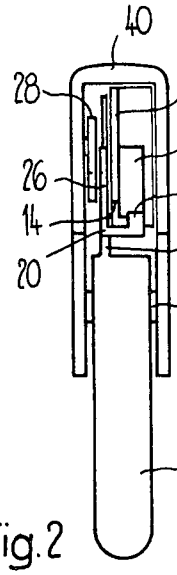
FIG. 2 shows the tool according to FIG. 1 seen from its narrow side located on the left.

The part 74 defining the channel 50,50' on the upper side comprises two tapped holes 76 and 78, which serve for the attachment of this channel part to the side wall of the first handle part 40. In FIG. 2, the tool is shown from its front side. This figure shows that the first housing part 40 is in the shape of an inverted U. The end 24 of the hook 20 is offset laterally with regard to its side 26. Due to this arrangement, the end 24 is aligned with the channel 50. The support part 10 comprises a lower edge as the support face or surface 14.

Figure 3:
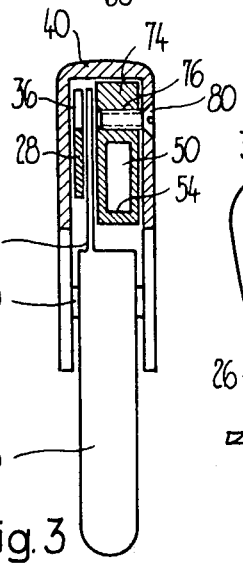
FIG. 3 shows the tool in cross section on line III—III of FIG. 1.

FIG. 3 shows the position of the fish-plate 36 adjacent the lever arm 64. The fish-plate 36 is located in the same plane as the intermediate member 28. At their respective connecting point, the parts 28 and 36 are recessed in a manner which is not shown. The part 54,74 surrounding the channel 50 is connected to the first handle part 40 by a counter-sunk screw 80 screwed into the thread 76.

Figure 4:
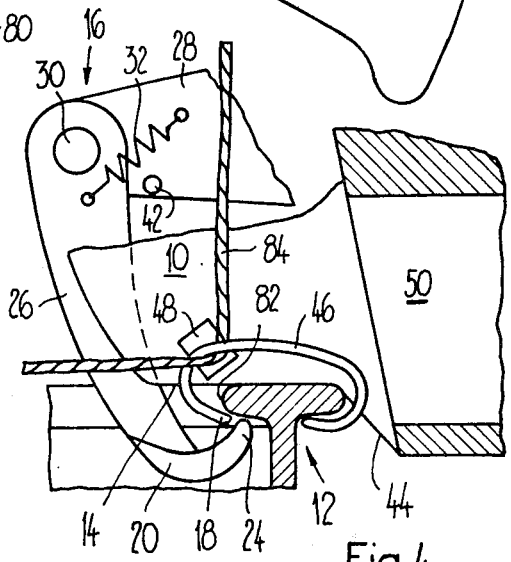
FIG. 4 is a partial view of the tool to an enlarged scale according to FIG. 1 when removing a ring traveller from a ring and FIG. 5 is a view from the inner side of the ring to illustrate the position of the yarn.

FIG. 4 is a cut-away view of the front part of the tool according to FIG. 1, to an enlarged scale. The reference numeral 16 designates generally the lifting part to which the intermediate member 28 and the hook 20 attached thereto and able to pivot about the pivot 30 belong. The hook 20 is pre-loaded in the direction of its end 24 intended for gripping, by a spring 32 engaging the intermediate member 28, in which case a stop 42 located on the intermediate member 28 serves as a limit.

The support face or surface 14 located on the support part 10 serves for supporting the tool on the upper side of a ring 12 of a ring-spinning or ring-twisting frame. The support face 14 adjoins a bearing face 44 at an angle, which face 44 is provided for bearing on the outer edge of the ring 12. The hook 20 is arranged so that it engages below a ring traveller 46 located on the ring 12, at its inner end 18.

For positioning the ring traveller 46 before it is removed, a permanent magnet 48 is let into a side face of the support part 10, which side face is adjacent the end 24 of the hook.

The operation of the tool will be described in more detail hereafter. For removing the ring traveller 46 from the ring 12, the tool is placed approximately 5 mm from the ring traveller 46 by the support surface 14 on the ring 12. The ring traveller 46 is now moved with the yarn 84 in the direction of the support part 10. The permanent magnet 48 thus lifts the ring traveller 46 on the inner side 82 of the ring 12 and pulls it towards itself. In this position of the ring traveller 46, the hook 20 engages by its end 24 under the ring traveller 46. By pressing the two handle parts 38 and 40 together, the hook is raised in the direction of the support face 14 and thus engages by its end 24 below the inner end 18 of the ring traveller 46. The end 18 of the ring traveller 46 is thus raised until it has passed over the inner edge 82 of the ring 12. Since the ring traveller 46 has been expanded due to this, after passing over the inner edge 82 of the ring 12, it is snapped by its own spring action radially outwards directly into the open channel 50, the front portion of which defines a collecting opening or mouth. During this operation, the ring traveller 46 carries out a movement such that the yarn 84 remains undamaged.

Figure 5:
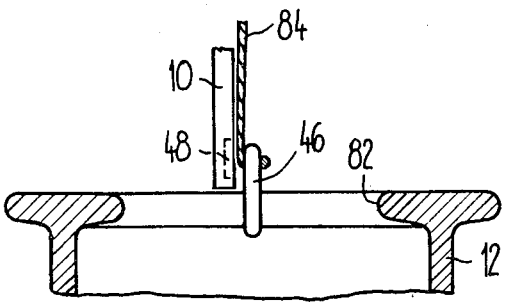

FIG. 5 shows the position which the yarn 84 assumes before the ring traveller 46 is lifted.

Although in this embodiment a tool for removing a C-shaped ring traveller from a ring with a horizontal flange was described, the method claimed as well as the tool can be used for removing an ear-shaped ring traveller from a ring with a vertical flange. In such a case, the ring traveller is engaged by a hook at its end which is directed downwards and is drawn inwards, so that it is snapped off the ring in an upwards direction.

It is not absolutely necessary that the member or hook engages behind the end of the ring traveller, but it may also be sufficient if the hook engages the ring traveller in the region of one end and pushes it away from the ring at this end.

Also, in contrast to the disclosed embodiment, it is not absolutely necessary that the tool is constructed in the form of pliers, since it is also conceivable to construct the tool in the form of a lever to be supported on the ring, without diverging from the scope of the invention.

While there are shown and described present preferred embodiments of the invention, it is to be distinctly understood that the invention is not limited thereto, but may be otherwise variously embodied and practiced within the scope of the following claims.

Accordingly, what is claimed is:

1. A method of removing a ring traveller from the ring of a ring-spinning or ring-twisting frame, comprising the steps of:

positioning a removal member relative to a ring traveller located on the ring;

manipulating the removal member so as to force one end of the ring traveller over an adjacent edge of a flange of the ring while the other end of the ring traveller is still in engagement with another flange of the ring, in order to thereby expand the ring traveller against its own spring tension;

releasing said one end of the ring traveller after it has cleared said adjacent edge of the ring, so that the ring traveller springs-off the ring in the direction of a collecting device; and retaining the released ring traveller in the collecting device after such ring traveller has sprung-off the ring.

2. A method as claimed in claim 1, wherein the ring traveller is aligned laterally by positioning means, drawn within its clearance by one end in the direction of the ring and held in this position until it is pulled or pushed away.

3. The method as claimed in claim 1, wherein the flange comprises a horizontal flange, the removal member engages below the ring traveller at said one end which is located within the ring, and said one end is pulled away over said adjacent edge of the ring flange which defines an inner edge of the ring flange, in order that said ring traveller springs off the ring substantially in a radial direction.

4. A device for removing a ring traveller from the ring of a ring-spinning or ring-twisting frame, comprising:

handle means containing a first handle part and a second handle part coacting with one another;

a support part provided for said first handle part;

said support part having a support surface and being connected with said first handle part;

movable gripper means arranged in confronting relationship with respect to said support surface and serving for gripping a ring traveller;

means for pivotably connecting said gripper means with said second handle part for enabling movement thereof relative to and in the direction of said support surface;

a positioning element for positioning the ring traveller which is to be removed from the ring;

said positioning element comprising a permanent magnet arranged at said support part;

means defining a collecting container having a collecting opening for receiving the ring traveller which has been removed from the ring;

said movable gripper means comprising a hook-like element; and said collecting opening of said collecting container being arranged neighboring said support surface.

5. The device as claimed in claim 4, wherein:

said permanent magnet is laterally embedded in said support part containing said support surface.

6. The device as claimed in claim 4, wherein the permanent magnet is embedded into a side surface of said support part.

7. The device as claimed in claim 4, wherein the collecting opening constitutes the beginning of a channel leading to the collecting container, and a shoulder is located between the base of the collecting container and the bottom of the channel which is at a higher level.

8. The device as claimed in claim 4, wherein, on its upper side, the collecting container has a permanently open emptying outlet.

9. The device as claimed in claim 4, wherein the two members are connected to handle which are interconnected in the manner of pliers by a pivot and are spread apart by a spring.

* * * * *